US010364992B2

(12) United States Patent
Rand et al.

(10) Patent No.: US 10,364,992 B2
(45) Date of Patent: Jul. 30, 2019

(54) VENTLESS OVEN HOOD FOR COMBINATION OVEN PROVIDING RAPID ACCESS

(71) Applicant: Alto-Shaam, Inc., Menomonee Falls, WI (US)

(72) Inventors: Thomas W. Rand, Cedarburg, WI (US); Janus Bartelick, Germantown, WI (US); Kim J. Menominee, Menomonee Falls, WI (US); Deborah E. Cukjati, West Allis, WI (US); J. K. Raghavan, Mequon, WI (US)

(73) Assignee: Alto-Shaam, Inc., Menomonee Falls, WI (US)

( * ) Notice: Subject to any disclaimer, the term of this patent is extended or adjusted under 35 U.S.C. 154(b) by 1267 days.

(21) Appl. No.: 14/050,549

(22) Filed: Oct. 10, 2013

(65) Prior Publication Data

US 2015/0059595 A1 Mar. 5, 2015

Related U.S. Application Data

(60) Provisional application No. 61/874,108, filed on Sep. 5, 2013.

(51) Int. Cl.

| | |
|---|---|
| ***F24C 15/20*** | (2006.01) |
| ***F24C 15/32*** | (2006.01) |
| ***F24C 7/08*** | (2006.01) |

(52) U.S. Cl.

CPC ..... *F24C 15/2035* (2013.01); *F24C 7/085* (2013.01); *F24C 15/2007* (2013.01); *F24C 15/322* (2013.01)

(58) Field of Classification Search

CPC ..... F24C 3/004; F24C 3/027; F24C 3/082; F24C 7/006; F24C 7/062; F24C 7/087; F24C 13/00; F24C 15/003; F24C 15/02; F24C 15/083; F24C 15/10; F24C 15/101; F24C 15/107; F24C 15/12; F24C 15/18; F24C 15/2035; F24C 15/006; H05B 6/80; H05B 2206/042; H05B 6/6423; H05B 6/6444; H05B 6/6482; H05B 6/6429; A21B 1/00; A21B 1/04

(Continued)

(56) References Cited

U.S. PATENT DOCUMENTS 4,941,400 A * 7/1990 Moore ..... A47J 27/0817 126/299 R
5,454,296 A * 10/1995 Beardsley ..... A47J 36/38 126/299 D (Continued)

OTHER PUBLICATIONS

U.S. Appl. No. 13/868,423, filed Apr. 23, 2013; Title—Oven with Automatic Open/Closed System Mode Control; Bartelick et al.

*Primary Examiner* — Tu B Hoang
*Assistant Examiner* — Masahiko Muranami
(74) *Attorney, Agent, or Firm* — Boyle Fredrickson S.C.

(57) ABSTRACT

A ventless fume hood is integrated with an oven to anticipate a conclusion of the cooking schedule executed by the oven and in this way to provide direct venting of the oven cavity before the oven door is opened. Proper venting of a multi-mode combination oven may be thereby performed and the door may be opened up immediately upon conclusion of the cooking schedule without the delay otherwise required to collect cooking fumes escaping through the partially open door.

17 Claims, 7 Drawing Sheets

(58) Field of Classification Search
USPC ..... 219/678, 679, 680, 681, 682, 685, 702, 219/715, 716, 717, 718, 719, 720, 721, 219/722, 724, 735, 739, 756, 757, 391, 219/400, 401, 413, 446.1, 449.1, 490, 219/492, 494, 553; 126/293, 312, 21 R, 126/80, 84, 198; 99/468, 325, 342, 331, 99/330, 337, 341, 447, 467, 470, 99/472–474, 451, 357, 385–389, 391
See application file for complete search history.

(56) References Cited

U.S. PATENT DOCUMENTS

D376,003 S 11/1996 Hansen et al.
6,987,246 B2 1/2006 Hansen et al.
7,282,674 B2 10/2007 Hansen et al.
7,755,005 B2 7/2010 Bartelick et al.
2004/0247762 A1* 12/2004 Xu ..... A47J 37/047 426/523
2006/0225726 A1* 10/2006 Andoh ..... A21B 3/04 126/20
2007/0102418 A1* 5/2007 Swank ..... A21B 3/02 219/400
2007/0194004 A1 8/2007 Hansen et al.
2007/0221199 A1* 9/2007 Hake ..... F24C 15/2021 126/299 R
2010/0230397 A1* 9/2010 Ohashi ..... A21B 3/04 219/401
2012/0017769 A1* 1/2012 Inoue ..... F24C 7/08 99/331
2012/0017770 A1* 1/2012 Sakane ..... F24C 15/327 99/331
2012/0294992 A1* 11/2012 Sager ..... F24C 15/327 426/231
2014/0311360 A1* 10/2014 Bartelick ..... F24C 3/124 99/468

* cited by examiner

VENTLESS OVEN HOOD FOR COMBINATION OVEN PROVIDING RAPID ACCESS

CROSS REFERENCE TO RELATED APPLICATIONS

This application claims the benefit of U.S. Provisional Application 61/874,108 filed Sep. 5, 2013 and hereby incorporated by reference.

BACKGROUND OF THE INVENTION

The present invention relates to combination ovens used in preparing food, and in particular, to a ventless hood for such an oven, the combination of oven and ventless hood providing rapid access to the oven interior at the conclusion of a cooking schedule.

High-end commercial ovens may provide for closed-system operation in which the oven volume is substantially sealed to retain heat and moisture and provide energy savings. Such closed-system operation is particularly desirable for "combination ovens" that may cook food using steam and fan driven (forced convection) hot air, but is also useful in convection ovens (without steam) and rotisserie ovens.

In closed-system ovens, expanding steam and air are vented so that the cooking process is performed without significant pressurization. This venting may occur through a condenser where the steam is cooled before exiting to the outside air, reducing the heating and humidification of the kitchen environment. In one common condenser design, the steam is passed through a water bath which cools and condenses the steam. The temperature of the water bath is monitored and fresh, cool water is introduced into the water bath as the temperature rises. Excess water from the bath passes through an overflow into the building drain system.

Such closed-system ovens can be used with so-called "ventless fume hoods" which provide internal filters to capture grease and cooking odors when the oven door is opened after a cooking schedule is complete. A common design for such ventless hoods provides an air intake positioned at the front of the oven just above the oven door. When the user attempts to open the oven door, a latch holds the oven door in a partially open position for a short period of time (for example, 20 seconds) to allow the ventless hood to capture and filter the air escaping through the door opening. After this time, the latch is released and the door may be fully opened.

Advanced "multi-mode" closed-system ovens may provide the ability to switch between standard closed operation described above and "open" operation in which the oven is vented during all or portions of the cooking cycle, for example, for humidity control, browning, or the like. This venting operation may be controlled through one or more electrically actuable "dampers" which may open or close to introduce outside air into the oven. A multi-mode oven suitable for this purpose is described in U.S. patent application Ser. No. 13/868,423 filed Apr. 23, 2013, assigned to the assignee of the present invention and hereby incorporated by reference.

When the dampers are open during the cooking cycle, grease and odors from an exhaust damper must be captured even though the oven door is closed and the ventless hood is not operating. The large door intake area needed by the ventless hood prevents a simple routing of the exhaust damper into the ventless hood without the odor and grease simply bypassing the filters and exiting backwards through the door intake area. On the other hand, constant operation of the ventless hood fan at a volume rate sufficient to capture odor or grease simultaneously from the damper and the large door intake area risks drawing so much an through the damper that the accuracy of the cooking process is adversely affected.

SUMMARY OF THE INVENTION

The present invention provides a ventless fume hood for operation with a multi-mode oven, where the fume hood anticipates the conclusion of the cooking schedule to provide fan assisted venting of the oven through an internal channel before the oven door is opened. By eliminating the front door vent, the damper may be directly connected to the fume hood for passive filtration of grease and odor without the risk of filter bypass. Anticipating the opening of the door also allows the ventless fume hood fan to remain off during most of the cooking schedule to avoid introducing variations in the cooking process. Operating the ventless fume hood fan for completion of the cooking schedule further allows the oven door to be opened immediately without delay once the cooking process is concluded unlike with typical ventless hood designs.

In one embodiment, the invention provides an oven having a housing with a door that can be opened to reveal a cooking volume containing a heater. A filter system, having a filter medium and a fan for moving air through the filter medium, connects to an exhaust channel communicating with the cooking volume through a second opening in the housing. An electronic computer controls the heater in accordance with a predetermined cooking schedule and activates the fan of the filter system in a venting process beginning at a time based on the cooking schedule, before a conclusion of the cooking schedule, to provide venting of the cooking volume before an anticipated opening of the door.

It is thus a feature of at least one embodiment of the invention to allow the door to be promptly opened after conclusion of the cooking schedule by close integration of the ventless hood and the oven. By allowing the ventless hood to be controlled by the oven cooking schedule, a filtering process can be started before the doors open.

The venting process may begin at a time based on a predetermined duration of the cooking schedule or at a temperature based on a predetermined temperature rise of the cooking schedule.

it is thus a feature of at least one embodiment of the invention to provide flexible anticipation of the conclusion of the cooking schedule for different cooking modes that cook food for a given period of time or until a particular temperature rise is obtained.

The exhaust channel may include a first electrically controlled damper for opening and closing the exhaust channel and the electronic computer may open this damper during the venting process.

It is thus a feature of at least one embodiment of the invention to preserve the ability of the oven to operate in a substantially sealed mode during much of the cooking schedule if desired. By positively controlling the opening of the exhaust channel, inadvertent venting cost, for example, by action of the convection fan inside the oven may be controlled.

The computer may also control a first electrically controlled damper according to the predetermined cooking schedule, but may override this control at the predetermined time to open the first electrically controlled damper.

It is another feature of at least one embodiment of the invention to permit filtration of venting that occurs during a mixed mode cooking cycle when a venting damper is opened. By eliminating the large door vent, the exhaust channel may be connected directly to the filter system for passive filtering at low rates that minimize disruption to the cooking process.

The oven may further include and intake channel communicating from the cooking volume to ambient air outside of the cooking volume through a third opening in the housing to provide intake air into the cooking volume during the venting process.

It is thus a feature of at least one embodiment of the invention to permit high levels of air turnover for fast venting such as may require a source of makeup air.

The intake channel may include a second electrically controlled damper and an electronic computer may open the second electrically controlled damper during the venting process.

It is thus a feature of at least one embodiment of the invention to permit air intake to bypass the normal condenser of a closed system oven for low air resistance required for rapid venting.

The oven may include a handle for opening the door and a door sensor detecting movement of the handle or door indicating a desire by a user to fully open the door, and a computer may activate the fan of the filter system to move air from the cooking volume upon detecting movement of the handle or door indicating a desire by a user open the door.

It is thus a feature of at least one embodiment of the invention to accommodate unscheduled needs to open the door by providing venting on a post-hoc basis.

In one embodiment, the oven may include a lock for holding the door closed and the computer may retain the lock in a locked position holding the door closed for a predetermined venting time after detection of movement of the handle or door indicating a desire by a user by a user to open the door.

It is thus a feature of at least one embodiment of the invention to provide a method of guaranteeing complete venting before the door is opened on an unscheduled basis.

The filter system may be in a housing without openings to the outside air through which air may be drawn into the filter system.

It is thus a feature of at least one embodiment of the invention permit passive venting of the exhaust channel without promoting filter bypass.

The filter system includes at least one filter medium and the fan is positioned after the filter medium to draw air through the filter medium.

It is thus a feature of at least one embodiment of the invention to provide improved airflow through the use of the fan other than convection fan in the oven and to position that fan in a manner shielded from cooking fumes by the filter media.

The filter system may include a grease filter and an activated carbon filter.

It is thus a feature of at least one embodiment of the invention to reduce both grease fumes and odors.

The activation of the fan may increase the airflow through the filter system to greater than 40 cubic feet per minute.

It is thus a feature of at least one embodiment of the invention to provide a rapid venting of the oven cavity that does not unduly interfere with cooking of the food.

The oven may include an airflow sensor detecting airflow through the filter when the fan is on and storing a value of airflow when the fan is on.

It is thus a feature of at least one embodiment of the invention provide a filter clogging signal available at all times even though the fan may only operate at the very end of the cooking schedule.

The computer may prevent operation of the heater before commencing the predetermined cooking schedule when a previously stored value of airflow indicates a clogging of the filters.

It is thus a feature of at least one embodiment of the invention to permit a determination of filter quality before commencing the cooking schedule even though the fan is not operating.

The oven may further include a filter medium detection switch indicating a presence of filter medium in the filter system and the computer may prevent operation of the heater when the filter medium detection switch indicates the filter medium is not present in the filter system.

It is thus a feature of at least one embodiment of the invention to prevent bypassing of clogged filter media by removal of the filter media.

The oven may include a steam generator generating steam from, a source of introduced water and/or may include a convection fan for circulating heated air within the interior volume.

It is thus a feature of at least one embodiment of the invention to provide a ventless fume hood suitable for combination type ovens.

The filter system may include a steam filter providing a steam condensing medium.

It is thus a feature of at least one embodiment of the invention to provide a ventless fume hood suitable for reducing the escape of steam into the kitchen area.

These particular objects and advantages may apply to only some embodiments falling within the claims and thus do not define the scope of the invention.

DETAILED DESCRIPTION OF THE PREFERRED EMBODIMENT

Oven

Figure 1:
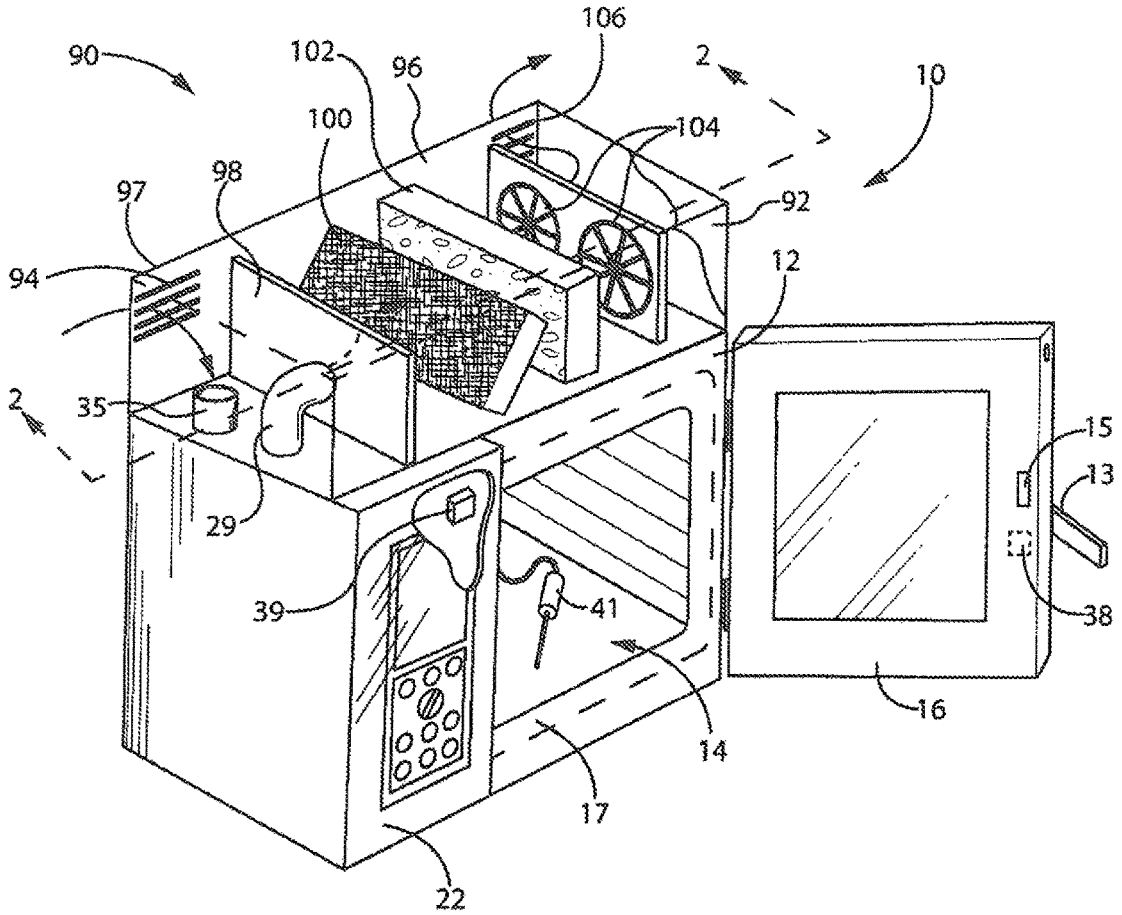
FIG. 1 is a simplified perspective view of a combination oven suitable for use with the present invention showing a housing having an openable door to reveal a cooking volume and showing a user interface on a front surface of the oven and further showing a ventless fume hood attached to the top of the oven.

Referring now to FIG. 1, a multi-mode oven 10 suitable for use with one embodiment of the present invention may provide a housing 12 defining a cooking volume 14. Sidewalk of the cooking volume 14 may present rack supports 11 holding conventional cooking racks for supporting pans or trays of food.

The cooking volume 14 may be accessed through a door 16 connected by a hinge at one vertical side of the cooking volume 14. The door 16 may close over the cooking volume 14 during the cooking operation as held by a latch assembly 15 (visible on the door 16 only). In the closed position, the door 16 may substantially seal against the cooking volume 14 by compressing a gasket 17 surrounding an opening of the cooking volume 14 in the housing 12. An optional electrically actuable lock 39 may he positioned near the door 16 in the housing 12 to electrically lock or unlock the door as will be discussed. The latch assembly 15 may be released by a handle 13 whose activation may be detected by a switch 38.

At one side of the cooking volume 14, the housing 12 may support a control panel 22 accessible by a user standing at a front of the oven 10. The control panel 22 may provide conventional electronic controls such as switches, buttons, and/or a touchscreen or the like that may receive oven control data from the user including a cooking schedule as will be described below.

Figure 2:
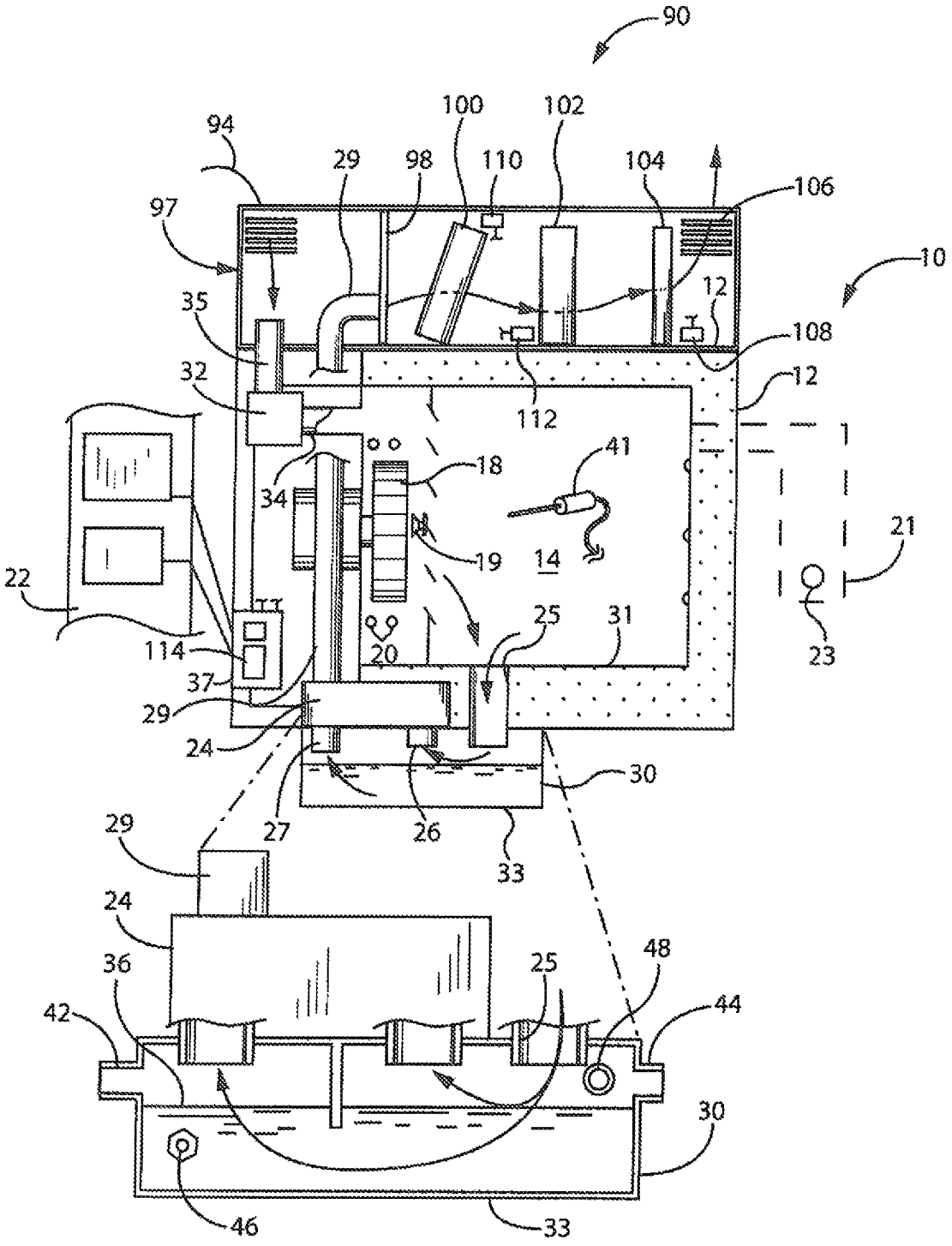
FIG. 2 is a section along line 2-2 of FIG. 1 showing internal filters and vent fans of the ventless fume hood and showing an internal convection fan, heater unit, and condenser unit of the oven and further showing motorized intake and exhaust dampers according to one embodiment of the present invention as well as an expanded cross-sectional view of the condenser unit.

Referring now also to FIG. 2, positioned within the housing 12 and communicating with the cooking volume 14 is a motor-driven convection fan 18 directing a stream of air across a heater element 20 into the cooking volume 14. The heater element 20 may be an electric heating element or a heat exchanger receiving heat from a gas flame or the like and may surround the convection fan 18.

In one embodiment, steam may be produced by a valve-controlled water jet 19 directing a spray of water on the fan 18 and the heater element 20 proximate to the fan 18. Alternatively, steam may be provided by a separate boiler 21 having a dedicated heater element 23 and communicating with the cooking volume 14.

Ovens of this type are commercially available from the Alto-Shaam Inc. of Menomonee Falls, Wis. and are described generally in U.S. Pat. No. 6,188,045 "Combination Oven with Three Stage Water Atomizer" hereby incorporated by reference.

Referring still to FIG. 2, a bottom wall 31 of the cooking volume 14 may provide a drainpipe 25 extending downwardly from the bottom wall 31 to a condenser chamber 30 positioned beneath the bottom wall 31. The drainpipe 25 may extend vertically (as shown) or may extend horizontally for a short distance before or after it is received within the condenser chamber 30.

in either case, the drainpipe 25 allows steam and water vapor to enter the condenser chamber 30 which provides a generally enclosed box whose upstanding sidewalls retain a pool of water having a water level 36. The lower end of the drainpipe 28 passing into the condenser chamber 30 stops above the bottom wall 33 and above a water level 36.

The condenser chamber 30 may in turn communicate generally with a first electronically controllable exhaust damper 24 through either of a bypass port 26 or a condenser port 27 of the exhaust damper 24 passing through an upper wall of the condenser chamber 30. The motorized exhaust damper 24 connects with an exhaust pipe 29 venting into a filter unit as will be described below. The exhaust damper 24 operates to determine whether greasy fumes and odor exiting from the cooking volume 14 must pass through the pool of water and out the condenser port and therefore rise to a certain level of pressure necessary for that passage or may bypass the water entirely through the bypass port 27 for low back-pressure venting of the cooking volume 14.

A second electronically controllable intake damper 32 is positioned with its exhaust port 34 near the fan 18 to permit outside air to be drawn into the cooking volume 14 from an intake pipe 35 extending to the external atmosphere outside the housing 12. In this regard, the exhaust port 34 of the intake damper 32 will be in a low-pressure region of the cooking volume 14 when the fan 18 is operating. Conversely, the drainpipe 25 feeding the ports 26 and 27 will be in a high-pressure region of the cooking volume 14 (when the fan 18 is operating) having a higher pressure than the low-pressure region. In this way when the motorized dampers 24 and 32 are open, air is actively drawn from the outer atmosphere into the cooking volume 14 through intake damper 32 and exhausted through drainpipe 25, condenser chamber 30, and exhaust damper 24 out of bypass port 27. It will be appreciated generally, therefore, that closing the motorized intake damper 32 and motorized exhaust damper 24 allows the oven 10 to operate in a conventional closed-system state to provide for high humidity, low heat loss, and low flavor transfer. Conversely, opening motorized dampers 24 and 32 allows the oven 10 to operate in an open state providing low humidity. It will be appreciated that the motorized dampers 24 and 32 may be operated according to a cooking schedule to cyclically open and close to provide for gradations between these two operating point extremes.

Referring to FIGS. 1 and 2, a controller 37 within the housing 12 may receive user input data from the control panel 22 for control of the oven 10 including, for example, cooking schedule. As will be discussed in greater detail below, the controller 37 generally provides an electronic computer executing a program stored in computer memory to control the heater element 20, fan 18, and the water jet 19, and the motorized dampers 24 and 32, turning the latter on and off as necessary to implement a particular cooking schedule. The controller 37 further communicates with electric locks 39, the door handle switch 38 and with various elements of the ventless hood as will be discussed below. The cooking schedule may provide for a fixed cooking time (e.g. 30 min.) or predetermined cooking temperature (for example 180° F.) typically as determined by a thermal probe 41 communicating with the controller 37.

As shown in FIG. 2, the condenser chamber 30 may provide for an overflow port 42 that generally connects to the sanitary sewer line but with some venting arrangement which allows the escape of gases. For example, the exhaust port 34 may discharge onto a floor drain or the like. Water in the condenser chamber 30 may be maintained at a cool temperature by a freshwater inlet 44 adding makeup water through a valve (not shown) also under the control of the controller 37 which may further communicate with a temperature gauge 46 so that additional water is added through the inlet 44 only when the temperature of the existing water rises above a certain amount. As water is admitted through inlet 44, excess water drains out through the overflow port 42 which provides an overflow lip 47 defining the water level 36. Steam passing through the drainpipe 25 may also pass into a steam collection port 48 that may recirculate back to the cooking volume 14. The steam collection port 48 may hold a temperature sensor (not shown) communicating with the controller 37 which may be used to provide steam temperature information useful for control of the oven 10.

A variation on this design is shown in U.S. patent application Ser. No. 13/306,687 filed Nov. 29, 2011, entitled "Grease Handling Apparatus for Closed-system Oven" assigned to the same assignee as the present invention and hereby incorporated by reference.

Importantly, the internal volume of the condenser chamber 30 is divided by a vertical baffle plate 40 extending down from an upper wall of the condenser chamber 30 below the water level 36 but above the bottom of the condenser chamber 30. This baffle plate 40 provides two distinct paths of water vapor flow from the cooking volume 14 depending on a state of operation of the exhaust damper 24. In a first path, water vapor passing into the condenser chamber 30 through the drainpipe 25 may pass out of a bypass port 26 without flowing through the water. Alternatively, in a second path, water vapor passing into the condenser chamber 30 through drainpipe 25 may flow through the water and beneath the vertical baffle plate 40 to condense any steam in that flow. This latter path introduces some back pressure resulting from a resistance to gas flow through the water and therefore tends to retain moisture within the cooking volume 14 while providing a release of excess pressure only.

Accordingly, the state of operation of the exhaust damper 24 may provide either a low resistance direct venting of the cooking volume 14 to the outside atmosphere (as will be used for open-state operation) or a higher resistance indirect venting of the cooking volume 14 through the water of the condenser chamber 30 (as will be used for closed-state operation).

Figure 3:
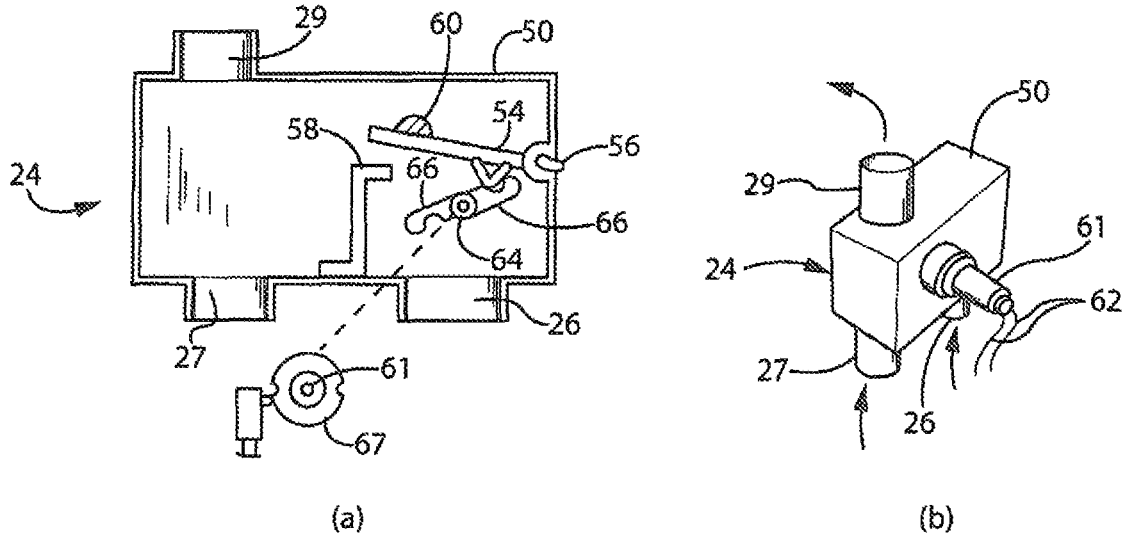
FIGS. 3*a* and 3*b* are a vertical elevational cross-sectional view and a perspective view of the exhaust damper of FIG. 2.

Referring now to FIG. 3, in this regard, motorized exhaust damper 24 may provide for a generally enclosed manifold 50 joining the intake ports 26 and 27 and exhaust pipe 29. The housing may be divided by a flapper valve 52 comprising a valve plate 54 pivoting at pivot point 56 attached between an upper edge of the valve plate 54 and a lower surface of an upper wall of the manifold 50. The valve plate 54 is normally pressed against a valve seat 58 by a biasing element 60 such as a weight. When so biased against the valve seat 58, the intake port 26 is isolated from the port 27 and an exhaust pipe 29.

A gearmotor 61 having motor leads 62 receiving control signals from the controller 37 may drive a hub 64 extending into the manifold 50 having diametrically opposed radially extending fingers 66 attached to rotate with the hub 64. In one direction of rotation, indicated by an arrow in FIG. 3, one of the fingers 66 may press against the valve plate 54 to lift it away from the valve seat 58 against the biasing element 60 to allow flow of water vapor through port 26 to exhaust pipe 29. This flow will be preferred over a flow through condenser port 27 because of the lack of back resistance from the water in the condenser chamber 30. When the gearmotor 61 continues rotation, the finger 66 is removed from the valve plate 54 allowing it to close under the influence of the biasing element 60. At this point, water vapor must flow primarily through port 27 to reach exhaust pipe 29 and thus through the water of the condenser chamber 30.

The gearmotor 61 may have a cam 67 communicating with a limit switch 68 or other sensor allowing the controller 37 to accurately control the finger 66 to stop motion with the valve plate 54 alternately at an open and closed position corresponding to an open and closed system state of the oven as will be further described.

Figure 4:
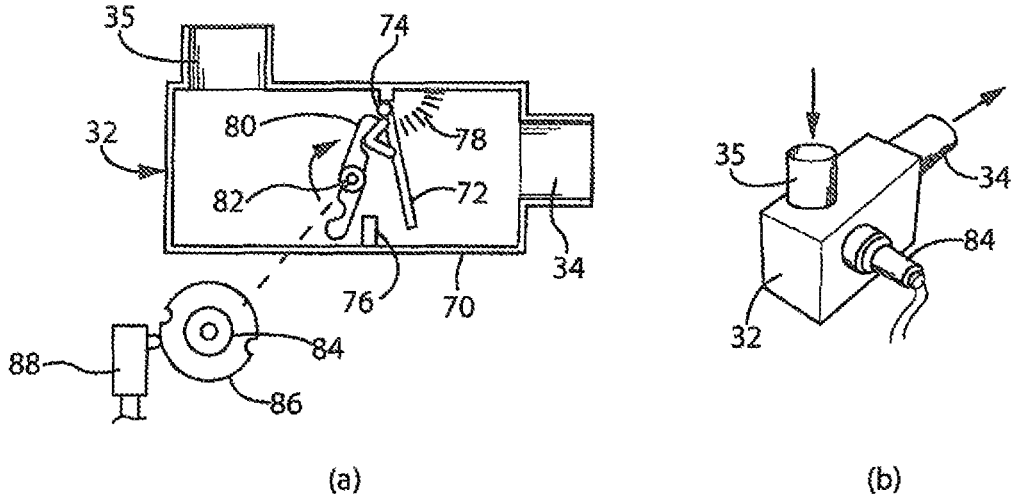
FIGS. 4*a* and 4*b* are figures similar to those of FIGS. 3*a* and 3*b* of the intake damper of FIG. 2.

Referring now to FIG. 4, the motorized intake damper 32 may likewise provide a manifold 70 divided internally by valve plate 72 pivoting at its upper edge about pivot 74 attached to an inner upper surface of the manifold 70. The valve plate 72 is normally held against a valve seat 76 as biased by biasing element 78, in this case depicted as a spring. In a manner similar to that described above, fingers 80 attached to a hub 82 driven by a gearmotor 84 may control opening of the valve plate 72 under the control of the controller 37. For the purpose of this control, the gearmotor 84 may include a cam 86 and limit switch 88 providing signals to the controller 37. In motorized intake damper 32, the valve plate 72, when closed, separates the exhaust port 34 from the intake pipe 35, and when open allows free flow of gas between the intake pipe 35 and exhaust port 34.

Filter System

Referring still to FIGS. 1 and 2, a ventless hood 90 may be positioned on top of the housing 12 of the oven 10. The ventless hood 90 may provide a housing 97 having a front wall 92 without intake vents communicating directly with the outside atmosphere. The front wall 92 may be temporarily moved or removed for access to the internal elements of the ventless hood 90.

Intake pipe 35 may project upward through the housing 12 into the volume of the housing 97 to receive intake air through a vent 94 in a rear wall 96 of the housing 97. Exhaust pipe 29 may also project upward through the housing 12 to then pass through a vertical divider plate 98 in the housing 97, the latter separating the space within the housing 97 receiving intake pipes 35 and exhaust pipe 29 from a filter portion of the ventless hood 90.

Air exhausted through the exhaust pipe 29 entering the filter portion of the ventless hood 90 passes through a grease filter 100 and then through an activated carbon filter 102, the combination providing filter media removing grease and odors from that air. The air from the exhaust pipe 29 may be moved through the filter media solely by action of the fan 18 within the oven 10 in a passive filtration mode. Alternatively, in an active filtration mode, air from the exhaust pipe 29 may be moved through the filter media by a combination of fan 18 and one or more ventless hood fans 104 position downstream from the carbon filter 102. In the active filtration mode, an air changeover of the cooking volume 14 of approximately 65 cubic feet per minute is obtained. Air passing through the filter media and passed through the hood fans 104 is expelled through a rear vent 106 in rear wall 96.

An air flow gauge or differential pressure gauge 108 may be positioned within the housing 97 to gauge airflow through the filters 100 and 102 and to provide a signal indicating whether those filters 100 and 102 need to be replaced as can be done through the front wall 92. Replacement is indicated when the pressure drop across the filters 101 and 102 rises above a predetermined amount when the hood fans 104 are active or airflow through the filters 101 and 102 drops below a predetermined amount when the hood fans 104 are active.

Mechanical switches 110 and 112 are positioned abutting the filters 101 and 102 to be activated when filters 100 and 102 are in place. These switches 110 and 112 provide a signal allowing prevention of operation of the oven 10 when both of the filters 101 and 102 are not in place as will he discussed below. Each of the mechanical switches 110, 112, pressure gauge 108, and fans 104 communicates with the controller 37 to be controlled or read by the controller 37 according to a program 114 executing on controller 37.

Figure 8:
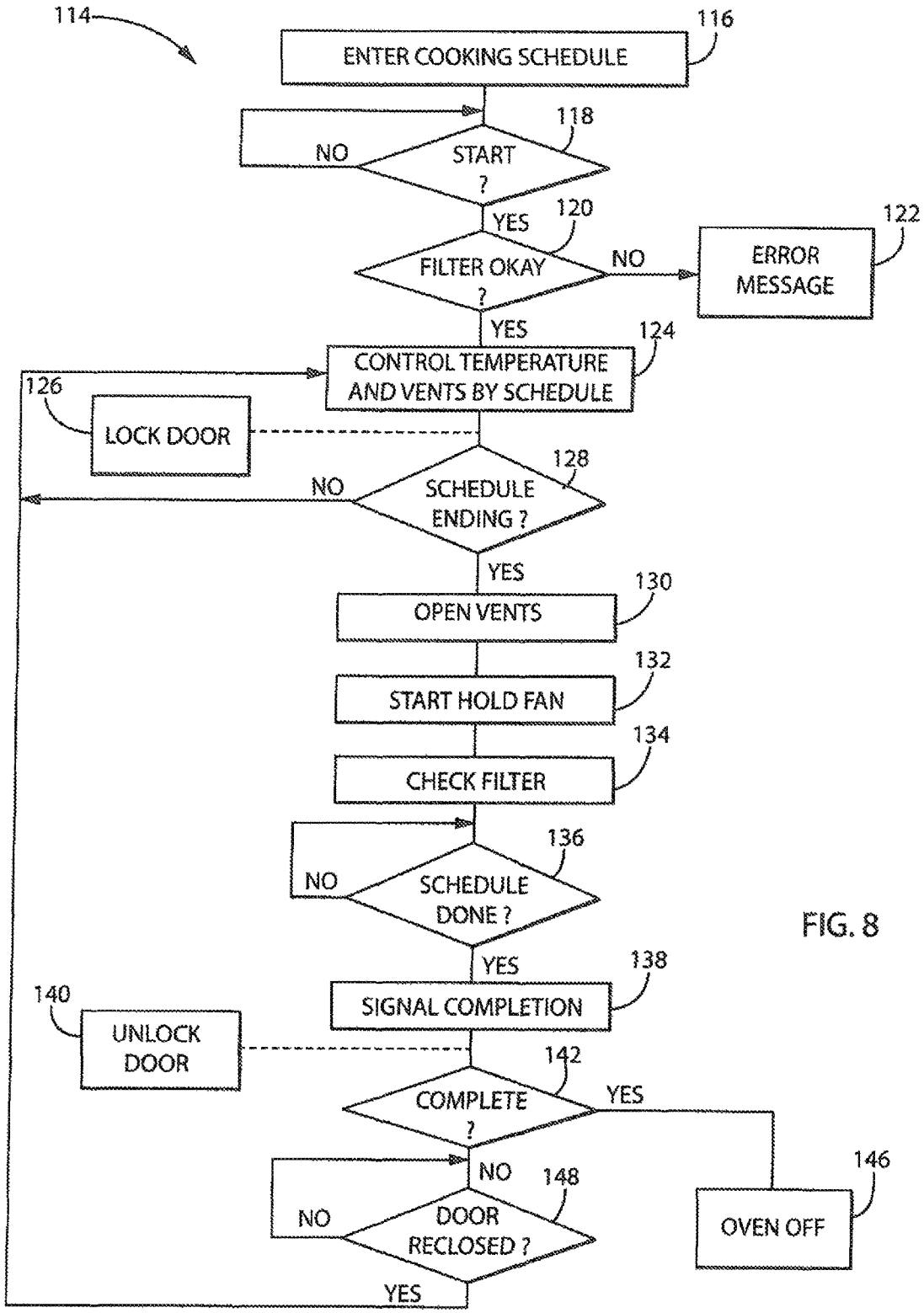
FIG. 8 is a flowchart of the program of the oven implementing the timings of FIGS. 5-7.

Referring no to FIGS. 2 and 8, in operation, the program 114 executing on the controller 37 may receive a cooking schedule as indicated by process block 116 entered by user of the oven. This cooking schedule provides a schedule that may be as simple as a cooking time (being a time duration after which the oven turns off), a set of shelf times (being different time durations for different shelves of the oven) or a cooking temperature (being a temperature experienced by the probe 41). The cooking schedule may variously control operation of the heater element 20, opening of the dampers 24 and 32, and control of the water jet 19 according to the time, temperature, humidity or the like. Such cooking schedules may be entered by hand or may be selected from a menu of prestored such cooking schedules according to techniques known in the art.

Once the cooking schedule has been entered, the user may start the cooking process as determined by decision block 118. At this time as indicated by decision block 120, the program 114 checks to see if the filter of the ventless hood 90 is in proper operating condition, meaning that filters 101 and 102 are in place and are not clogged. If the filters 101 and 102 are not functioning, an error messages is indicated at process block 122 and starting of the oven 10 is prevented until proper maintenance of the filters 101 and 102 is performed.

Determination as to whether the filter is clogged may be based on a previous time during which the oven fan 104 was operating in a previous cooking cycle or may be determined by a momentary operation of the oven fan 104 before the oven 10 has heated as measured by pressure gauge 108 (shown in FIG. 2).

If the filter is in functional condition, the program 114 executes the entered cooking schedule in which the control of the temperature of the oven 10 and humidity of the oven 10 and the like is performed as indicated by process block 124. Optionally at this time or a few minutes after beginning of the cooking schedule, the door of the oven 10 is locked as indicated by process block 126 using lock 39 shown in FIG. 1.

The cooking schedule proceeds using, for example, a clock to increment through a schedule of temperatures, humidities and the like according to a time function of the cooking schedule or during which temperature of probe 41 is monitored. At decision block 128 an imminent ending of the schedule is checked. For example, when the cooking schedule is a predetermined cooking time, decision block 128 may detect when a predetermined time before the end of the cooking schedule has occurred. This predetermined time is selected to be sufficient to vent the cooking volume 14, for example, 25 seconds to 1 minute and 45 seconds. Alternatively, when the cooking schedule is a predetermined temperature, decision block 128 may detect when a temperature sensed by the probe 41 is a predetermined number of degrees, for example 5° F., before the end of the cooking schedule temperature. When the cooking schedule includes a number of different times and/or conditions, for example, for different shelves of the oven 10, this process may be repeated appropriately for times preceding the termination of each cooking schedule.

When decision block 128 detects an imminent conclusion of the cooking schedule, as indicated by process block 130, dampers 24 and 32 are open irrespective of the setting of the cooking schedule. The hood fan 104 is then started at process block 132. Normally the hood fan 104 does not operate prior to this time and remains off to save power and to prevent interference with the cooking process.

During the running of the hood fan 104, the filter media may be checked for clogging as indicated by process block 134 using the pressure gauge 108 which indicates clogging of the filters only when the filter fan 104 is operating. As noted above, this check may be used and stored for the next time decision block 120 is reached and will normally provide a maintenance reminder to the user at this time.

At decision block 136, the completion of the cooking schedule is evaluated according to a cooking time having fully elapsed or proper cooking temperature having been reached. While the completion of the cooking schedule does not complete, the temperature of the oven may be maintained although steam may be deactivated. This approach allows the invention to accommodate shelf timers in which some food will be removed and other food will remain for additional cooking. If the cooking schedule is complete or a part of the cooking schedule is complete, as in the case of different shelf timers, a signal is provided to the user in the form of a light or sound as indicated by process block 138. At this time or slightly before as indicated by process block 140 the door may be unlocked if it was previously locked.

If the completion of the schedule of decision block 136 completes an entire schedule as determined at decision block 142, the oven heater is turned off as indicated by process block 146. The dampers 24 and 32 may be held open for a brief cool down interval while the fan 104 continues to operate.

If the completion of the schedule of decision block 136 is only a portion of the schedule, then at decision block 148 a reclosure (opening then closing of the door) is detected upon which the program returns to decision block 136 for completion of the next cooking schedule portion. Before reclosure of the door, the oven heater element 20 may be temporarily turned off and dampers 24 and 32 held open and fan 104 may continue to operate. After the doors closed, control of the dampers 24 and 32 may be according to the cooking schedule (generally closed) and the fan 104 turned off and the program loops back to process block 124.

Figure 5:
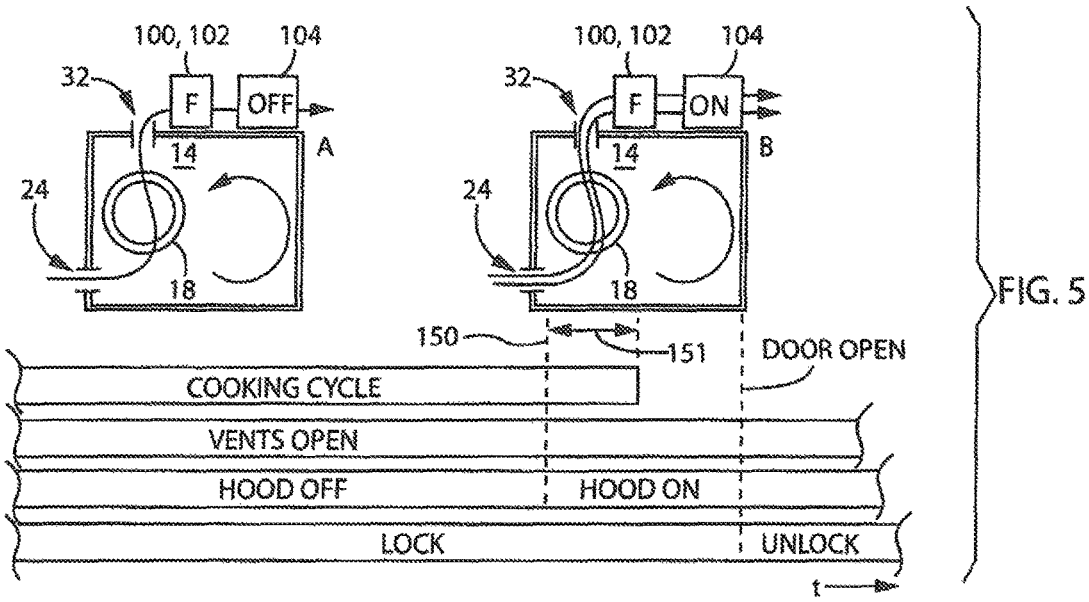
FIG. 5 is a timing diagram and schematic representation of the oven as it operates according to a program executed by the oven, the program controlling the vent fan and dampers according to a cooking schedule in which the dampers remain open.

Referring now to FIG. 5, operation of the program 114 during an open cycle cooking schedule (or an open cycle portion of the cooking schedule) may open dampers 24 and 32 during the cooking schedule, for example, to promote browning and low humidity cooking. The open dampers 24 and 32 will provide a low flow rate through the filters 100, 102 caused by operation of the convection fan 18 at about 15 cubic feet per minute as depicted by schematicized oven diagram A. At this time the fan 104 is off. This low flow rate does not unduly interfere with uniform temperature control in the cooking volume 14.

At vent initiation time 150 (sensed by decision block 128 of FIG. 8) the hood fan 104 is turned on as indicated in schematicized oven diagram B providing more than approximately 40 cubic feet per minute of exhaust and typically 65 cubic feet per minute of exhaust of the cooking volume 14, being the combined effect of convection fan 18 and ventless hood fan 104.

Figure 6:
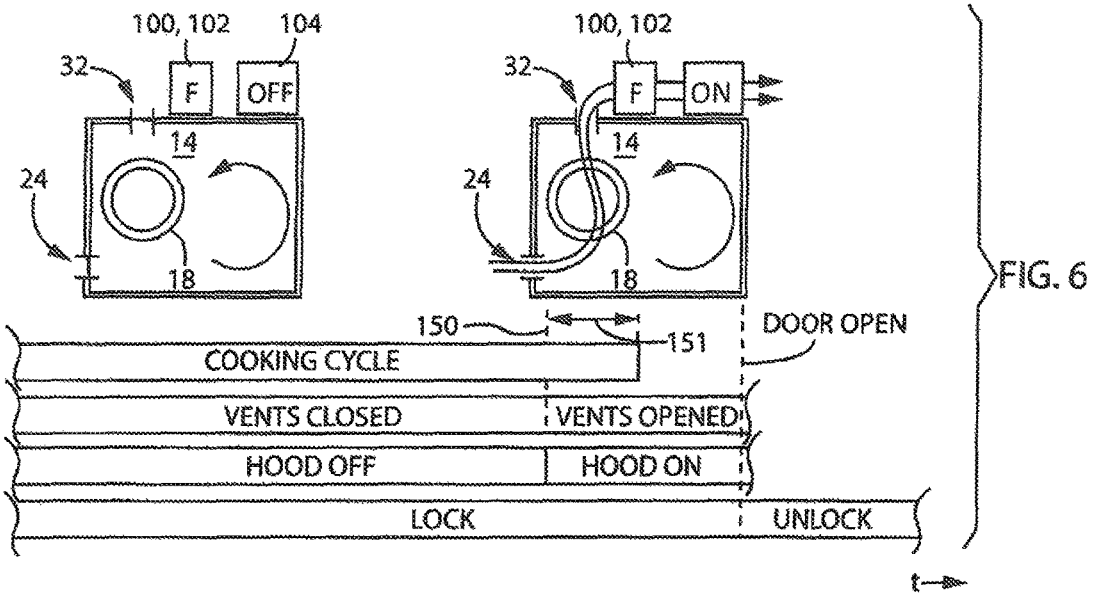
FIG. 6 is a figure similar to that of FIG. 5 showing the timing implemented by the program during a cooking schedule in which the dampers remain closed for closed-mode cooking.

Referring now to FIG. 6, in contrast, in a closed cycle cooking schedule (or a closed cycle portion of the cooking schedule) that normally has the dampers 24 and 32 closed, for example, for steam cooking or the like, prior to vent initiation time 150, dampers 24 and 32 may be closed and no filtering performed. At the vent initiation time 150, the dampers 24 and 32 are open irrespective of the schedule cooking schedule and the hood fan 104 is turned on to provide rapid exhaust of the cooking volume 14.

Figure 7:
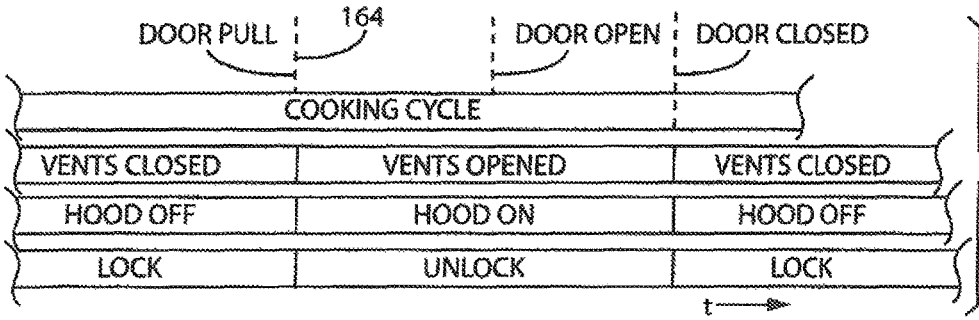
FIG. 7 is a figure similar to the timing diagrams of FIGS. 5 and 6 showing operation of the program during unexpected door opening during the cooking schedule.
Figure 9:
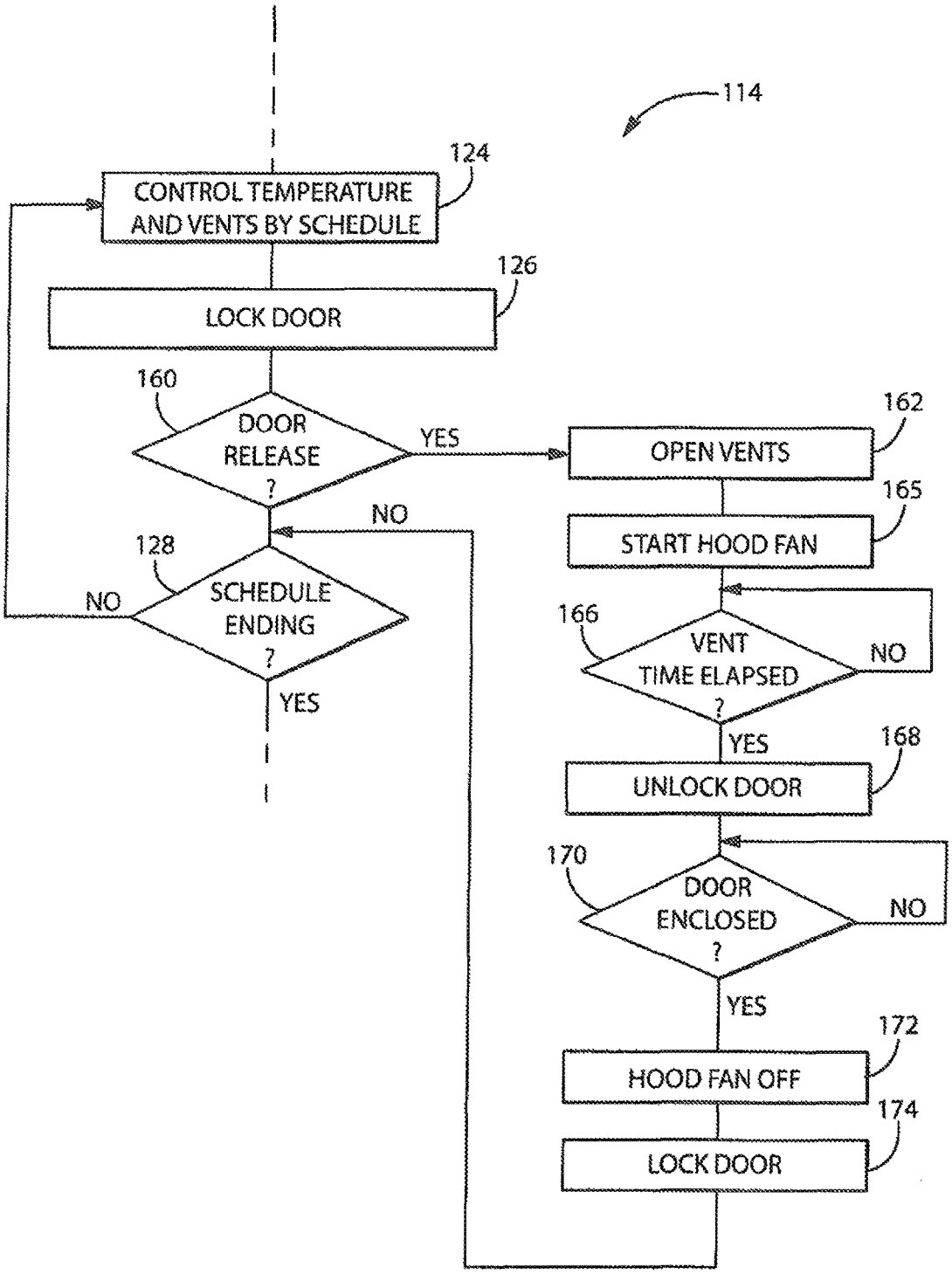
FIG. 9 is a flowchart of the program implementing a response to an unexpected door opening a FIG. 7.

Referring now to FIGS. 7 and 9, after the oven door is optionally locked per process block 126, an attempt to open the door may be nevertheless detected at decision block 160. If there is no attempt to open the door handle 13, the program proceeds to decision block 128 as has been described previously with respect to FIG. 8. If a door release is attempted, for example, at a time 164, the program 114 proceeds to process block 162 and the vents are opened (regardless of the schedule) and the hood fan 104 started at process block 165. A vent time is imposed as indicated by decision block 166 generally equal in length to the pre-venting time 151 for example, approximately 60 seconds. At that time, if the door was previously locked, the door is unlocked per process block 168. The hood fan 104 may be turned off at this time or remain on to limit the expulsion of hot air from the oven 10 and to allow the pre-venting time 151 to be made as short as possible. At decision block 170, reclosure of the door may be detected (e.g. the door 16 being opened and then reclosed). Upon such reclosure, the hood fan 104 is turned off as indicated by process block 172 and the lock optionally reestablish at process block 174 whereupon the program returns to decision block 128. In this way, unexpected opening of the door may be accommodated with minimal escape of cooking fumes.

Figure 10:
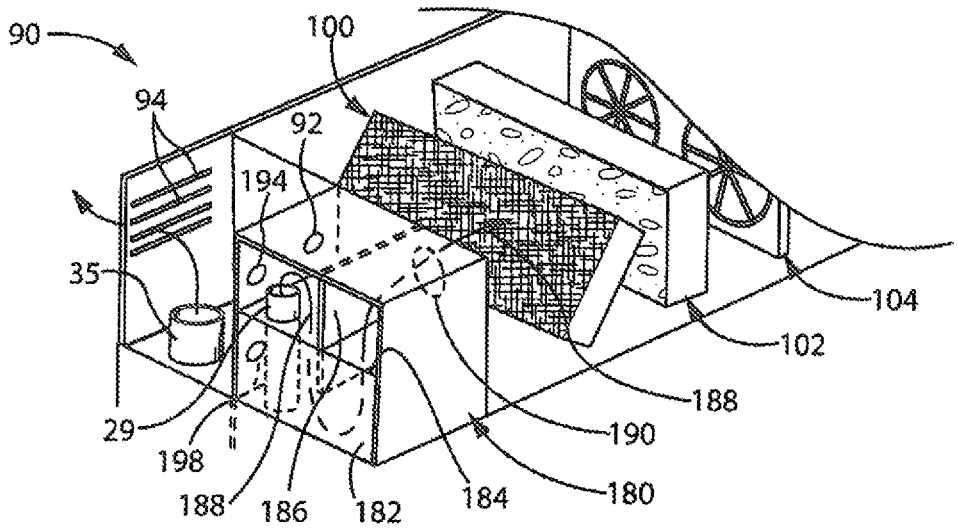
FIG. 10 is a fragmentary detail of a filter system similar to that of FIG. 1 showing the addition of a water bath steam filter.

Referring now to FIG. 10, in one embodiment, the ventless hood 90 may include a steam filter 180 in series with the grease filter 100 and odor filter 102 and placed before the fan 104. In one embodiment, the steam filter 180 provides for a contained water bath 182 with exhaust pipe 29 extending upward through the water level 184 of the water bath 182 on a first side of a downwardly extending partition 186. The partition 186 is constructed so that oven fumes 188 passing out of exhaust pipe 29 must pass downward through the water bath 182 beneath the partition 186 in order to exit through an exit port 190 of the steam filter 180 to then be received by the grease filter 100.

The steam filter 180 may provide a water inlet 192 for introducing water into the water bath 182, an overflow port 194 for limiting the height of the water bath 182 to water level 184. And a temperature sensor 198 for measuring the temperature of the water bath 182. In a manner similar to that described above with respect to the condenser chamber 30, a valve system (not shown) may add water through the water inlet 192 when the temperature of the temperature sensor 198 rises above a predetermined amount. This introduced water flushes heated water out the overflow port 194 to lower the temperature of the water bath 182 for effective steam condensation. The overflow port 194 may lead via an internal duct to an exit also used by the condenser chamber 30 ultimately leading to a floor drain or the like. The height of the water level 184 is set so that a pressure required for oven fumes 188 to pass through the water bath 182 can be achieved by operation of the convection fan 18 alone without operation of fans 104.

Figure 11:
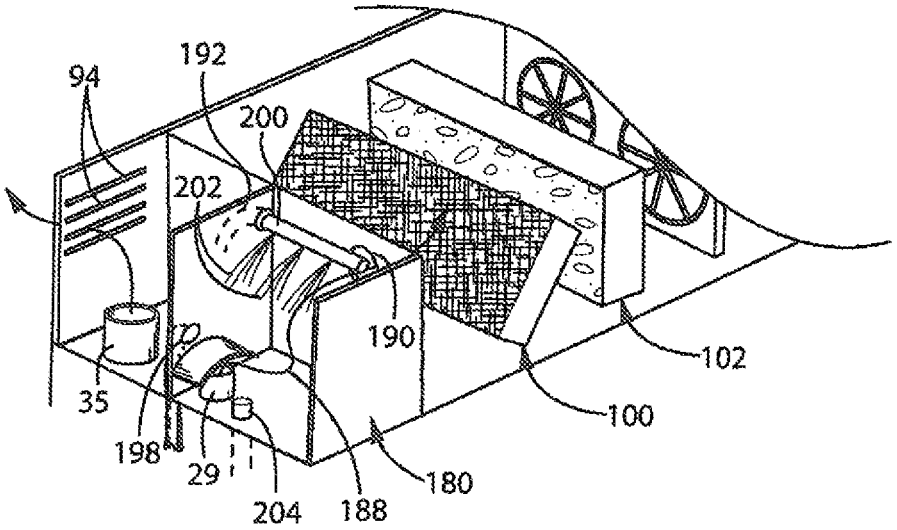
FIG. 11 is a figure similar to that of FIG. 10 showing the addition of a water spray steam filter.

Referring now to FIG. 11, in an alternative embodiment the steam filter 180 may provide a mist spray nozzle 200 attached to the water inlet 192. The spray nozzle 200 provides a high surface area spray mist 202 through which oven fumes 188 must pass in exiting exhaust pipe 29 and traveling to exit aperture 190. A drain port 204 may be provided in the lower wall of the steam filter 180 to capture excess water from the mist 202 and condensed steam. No partition 186 or water bath 182 is necessary in this embodiment although the two techniques may be combined.

Referring momentarily to FIG. 8, operation of the steam filter 180 of FIG. 10 in terms of water temperature monitoring may be active only when the oven is operating between process block 116 and process block 146. The steam filter 180 of FIG. 11 may likewise be activated only during this time or may be activated in terms of providing the mist 202 only when the hood fan 104 is active per process block 132 or process block 165 of FIG. 9.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof; and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

References to "a control board" and "a processor" can be understood to include one or more microprocessors that can communicate in a stand-alone and/or a distributed environment(s), and can thus be configured to communicate via wired or wireless communications with other processors, where such one or more processor can be configured to operate on one or more processor-controlled devices that can be similar or different devices. Furthermore, references to memory, unless otherwise specified, can include one or more processor-readable and accessible memory elements and/or components that can be internal to the processor-controlled device, external to the processor-controlled device, and can be accessed via a wired or wireless network.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

What we claim is:

1. An oven comprising:

a housing providing a first opening coverable by a door, the door closing to define an interior cooking volume and opening to provide access to the cooking volume;

a heater communicating with the cooking volume to heat the cooking volume;

a steam generator generating steam from a source of introduced water from a water line;

a filter system providing filter medium removing grease and odor from air flowing therethrough and a filtration fan downstream from the filter medium for moving air through the filter medium;

an exhaust channel communicating from the cooking volume to the filter system through a second opening in the housing;

a first electrically controlled damper positioned between the cooking volume and the filter system and electrically controlled by a controller to move between a closed state preventing movement of air from the cooking volume through the exhaust channel to the filter system and an open state allowing movement of air from the cooking volume through the exhaust channel to the filter system; and the controller comprising an electronic computer executing a program stored in memory to control the heater, steam generator, damper, and filtration fan in accordance with a predetermined cooking schedule to:

(a) during a first cooking mode, activate the heater and steam generator, position the damper in the closed state, and deactivate the filtration fan to allow for steam cooking in a closed system oven, and beginning at a predetermined time based on the cooking schedule before a conclusion of the cooking schedule, position the damper in the open state and activate the filtration fan to allow for fast movement of air from the cooking volume before opening of the door; and (b) during a second cooking mode, activate the heater, deactivate the steam generator, position the damper in the open state, and deactivate the filtration fan to allow for low humidity cooking in an open system oven, and beginning at a predetermined time based on the cooking schedule before a conclusion of the cooking schedule, keep the damper in the open state and activate the filtration fan to allow for fast movement of air from the cooking volume before opening of the door.

2. The oven of claim 1 wherein the first cooking mode and second cooking mode begin at a temperature based on a predetermined temperature rise of the cooking schedule.

3. The oven of claim 1 wherein the electronic computer further controls the first electrically controlled damper according to the predetermined cooking schedule and overrides control of the first electrically controlled damper according to the predetermined time to open the first electrically controlled damper.

4. The oven of claim 1 further including an intake channel communicating from the cooking volume to ambient air outside of the cooking volume through a third opening in the housing to provide intake air into the cooking volume during the venting process; and wherein the intake channel includes a second electrically controlled damper for opening and closing the intake channel and wherein the electronic computer executes the program to open the second electrically controlled damper during the venting process.

5. The oven of claim 1 wherein the door includes a handle for opening the door and further including a door sensor detecting movement of the handle or door indicating door opening by a user and wherein the electronic computer executes a stored program to further activate the filtration fan of the filter system to move air from the cooking volume upon detecting movement of the handle or door indicating door opening by a user.

6. The oven of claim 5 further including a lock for holding the door closed and wherein the electronic computer executing the stored program retains the lock in a locked position holding the door closed for a predetermined venting time after detection of movement of the handle or door indicating door opening by the user.

7. The oven of claim 1 wherein the filter system is in a housing without venting surfaces on a front of the housing on a same side as the door of the oven through which air may be drawn into the filter system from the oven cavity.

8. The oven of claim 1 wherein the filter system includes at least one filter medium and the filtration fan is positioned after the filter medium to draw air through the filter medium.

9. The oven of claim 1 wherein the filter system includes a grease filter and an activated carbon filter.

10. The oven of claim 1 wherein the filter system includes a steam filter providing a steam condensing medium; wherein the steam filter is selected from the group consisting of a sprayed mist of condensing water and a tank of water, through which air moved by the filtration fan must pass.

11. The oven of claim 1 wherein the activation of the filtration fan increases airflow through the filter system to greater than 40 cubic feet per minute.

12. The oven of claim 1 further including an airflow sensor detecting airflow through the filter when the filtration fan is on and storing a value of airflow when the filtration fan is on.

13. The oven of claim 1 wherein the electronic computer further executes the program to prevent operation of the heater before commencing the predetermined cooking schedule when a previously stored value of airflow indicates a reduction in air flow of the filter system.

14. The oven of claim 1 further including a filter medium detection switch indicating a presence of filter medium in the filter system and wherein the electronic computer further executes the program to prevent operation of the heater for commencing the predetermined cooking schedule when the filter medium detection switch indicates a filter medium is not present in the filter system.

15. The oven of claim 1 further including a convection fan for circulating heated air within the interior volume.

16. The oven of claim 15 wherein the convection fan operates to move air from the cooking volume through the exhaust channel at a first rate when the filtration fan of the filter system is not activated, the first-rate decreasing humidity of the cooking volume and being less than a second rate of air movement occurring when the filtration fan of the filter system is activated.

17. An oven comprising:

a housing providing a first opening coverable by a door, the door closing to define an interior cooking volume and opening to provide access to the cooking volume;

a heater communicating with the cooking volume to heat the cooking volume;

a steam generator generating steam from a source of introduced water from a water line;

a convection fan for circulating heated air within the interior volume;

a filter system providing filter medium removing grease and odor from air flowing therethrough and a filtration fan downstream from the filter medium for moving air through the filter medium;

an exhaust channel communicating from the cooking volume to the filter system through a second opening in the housing;

a first electrically controlled by a controller damper positioned between the cooking volume and the filter system and electrically controlled to move between a closed state preventing movement of air from the cooking volume through the exhaust channel to the filter system and an open state allowing movement of air from the cooking volume through the exhaust channel to the filter system; and an intake channel communicating from the cooking volume to ambient air outside of the cooking volume through a third opening in the housing;

a second electrically controlled damper positioned between the cooking volume and ambient air outside of the cooking volume and electrically controlled by a controller to move between a closed state preventing movement of ambient air into cooking volume through the intake channel and an open state allowing movement of ambient air into the cooking volume through the intake channel;

the controller comprising an electronic computer executing a program stored in memory to control the heater, steam generator, first electrically controlled damper, second electrically controlled damper, and filtration fan in accordance with a predetermined cooking schedule to:

(a) during a first cooking mode, activate the heater and steam generator, position the first and second electrically controlled dampers in the closed state, and deactivate the filtration fan to allow for steam cooking in a closed system oven, and beginning at a predetermined time based on the cooking schedule before a conclusion of the cooking schedule, position the first and second electrically controlled dampers in the open state and activate the filtration fan to allow for fast movement of air from the cooking volume before opening of the door; and (b) during a second cooking mode, activate the heater, deactivate the steam generator, position the first and second electrically controlled dampers in the open state, and deactivate the filtration fan to allow for low humidity cooking in an open system oven, and beginning at a predetermined time based on the cooking schedule before a conclusion of the cooking schedule, keep the first and second electrically controlled dampers in the open state and activate the filtration fan to allow for fast movement of air from the cooking volume before opening of the door.

* * * * *